US005425542A

United States Patent [19]

Blackwood et al.

[11] Patent Number: 5,425,542

[45] Date of Patent: Jun. 20, 1995

[54] ILLUMINATED PROJECTILE

[76] Inventors: James D. Blackwood, 318 Terrace Ave., #3, Cincinnati, Ohio 45220; John R. Janzen, P.O. Box 9458, Cincinnati, Ohio 45209-0458

[21] Appl. No.: 61,480

[22] Filed: May 12, 1993

[51] Int. Cl.[6] ..... A63B 65/02

[52] U.S. Cl. ..... 273/416; 273/423

[58] Field of Search ..... 273/416, 423

[56] References Cited

U.S. PATENT DOCUMENTS

| | | | |
|---|---|---|---|
| 4,340,930 | 7/1982 | Carissimi | 362/204 |
| 4,547,837 | 10/1985 | Bennett | 362/186 |
| 4,840,383 | 6/1989 | Lombardo | 273/416 |
| 4,989,881 | 2/1991 | Gamble | 273/416 |
| 5,058,900 | 10/1991 | Denen | 273/416 |

*Primary Examiner*—William H. Grieb

*Attorney, Agent, or Firm*—Jim Blackwood

[57] ABSTRACT

An illuminated device such as a projectile or dart is provided with a battery, one or more light emitting diodes and a switching device wherein switching is accomplished either by relative motion between body and shaft, or by removal and re-insertion of the flite. Conductive elements may be incorporated into the components of the device which may be formed of a conductive material which may be castable or moldable such as plastic, and which may be formed into separate, electrically isolated conductive paths by a molding process.

13 Claims, 8 Drawing Sheets

ILLUMINATED PROJECTILE

FIELD OF THE INVENTION

The instant invention relates to illuminated bodies and to illuminated projectiles in general and to illuminated projectiles such as recreational darts in particular.

DESCRIPTION OF RELATED ART

Various attempts have been made to produce an illuminated projectile such as a dart, none of which has met with widespread commercial success, even though such darts did function as intended. The lack of success was largely due to one of two factors: either the device was too fragile to endure the rigors of its environment, or its complexity precluded economic manufacture. The present device overcomes those objections. In the prior art, reference will be had to Denen, U.S. Pat. No. 5,058,900, in which an arrangement of concentric springs and the process of forming the light-emitting-diode (LED) leads, create relative complexity, and the forming of a large cavity within the threaded portion of a plastic shaft provides a relatively frail and fragile construction. Also Reference will be had to: Lombardo, U.S. Pat. No. 4,840,383, in which a complex and therefore expensive switching arrangement is disclosed; see also Gamble, U.S. Pat. No. 4,989,881; Bennett, U.S. Pat. No. 4,547,837; and Carissimi, U.S. Pat. No. 4,340,930.

SUMMARY AND OBJECTS OF THE INVENTION

It is therefore an object of this invention to provide a new and novel illuminated projectile.

A further object is to provide a simple, inexpensive and reliable switching arrangement, which does not appreciably weaken the structure of the projectile.

A still further object is a dart in which the dart shaft is illuminated by one or more LED(s).

Yet still another object is a dart in which the flite guard is illuminated by an LED.

An object of this invention is an illuminated dart in which the dart shaft contains conducting and non-conducting portions, formed of a plastic material.

A further object is a dart wherein said shaft containing said conductive portions may also contain one or more LEDs embedded therein.

An object is to provide a dart, with an illuminated flite guard, wherein the flites of said dart contain conductive elements.

It is yet another object of the invention to provide an illuminated device in which insertion and removal of a flite-like element constitutes an electrical switching arrangement.

The foregoing objects are achieved by providing a projectile such as a dart having a body with a cavity for holding a battery, a shaft with one or more LEDs positioned therein, and conductive elements which may be formed of a conductive plastic, arranged for completion of an electrical circuit between the battery and the LED(s), and a switch which functions by relative movement between the shaft and body. A flite guard may also be provided having an LED positioned therein and conductive elements for connection to conductive surfaces of a flite, and therefrom to conductive elements of the shaft. Switching may also be accomplished by removal and re-insertion of the flite.

DESCRIPTION OF THE PREFERRED EMBODIMENT

Figure 1:
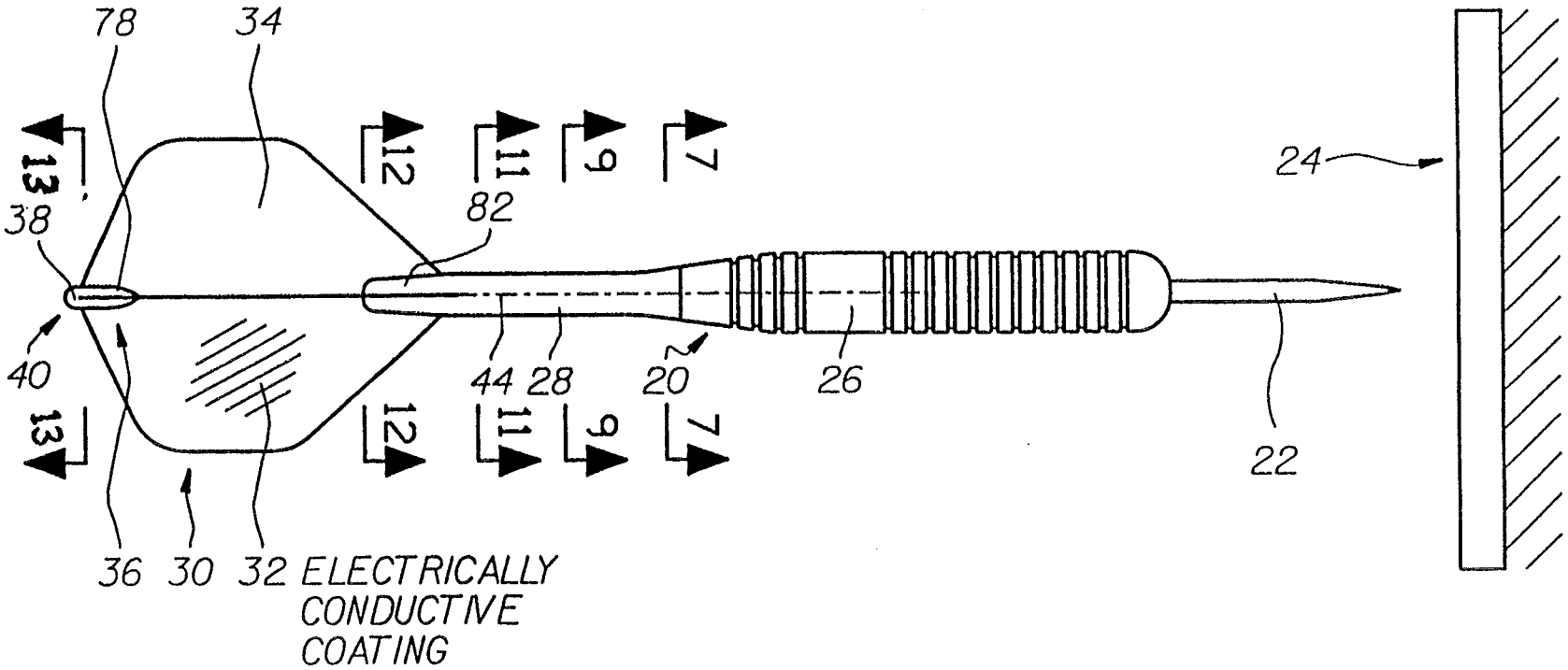
FIG. 1 is a side view of one embodiment of the invention.

Referring to FIG. 1, it can be seen that a dart 20 has in all respects the general appearance of a conventional dart used in the game of recreational darts, having a device 22 for attachment of the dart 20 to a target 24 upon impact therewith. The device 22 in this case is a pointed end, but it could be a suction cup, soft tip, or other design. A body 26, carries the device 22 either rigidly, or is movably attached thereto, such as for example in a "Hammer Head" configuration which is common in the trade, or as a hypodermic attachment such as may be used for anesthetizing wild animals. A shaft 28, is normally threadably attached to the body 26 but attachment by other means is possible. A flite or tail feathers 30 is attached to the shaft 28 by conventional means; said flite 30, being of conventional design, may be constructed of four shaped and bent pieces of plastic sheet laminated together with decorative designs thereon. Said designs may partially consist of reflective coatings. As shown, an electrically conductive coating 32 may be applied to the surface(s) of the flite 30. The flite 30 may be the same or similar to that used in projectiles fired from guns, rifles, or other means. One or more vanes 34 may be included in the flite 30. A flite guard 36 of anodized aluminum or other suitable material may be provided with slits or the like to facilitate attachment to the vanes 34, but other means of attachment may be utilized. An LED 38 is carried in an end 40 of the flite guard 36. The end 40 as well as the flite guard 36 may be made of a translucent or transparent material such as plastic, acrylic, Lexan® or the like. The shaft 28 may also be made of a transparent or translucent material similar to that used in the flite guard 36 and as such an LED 42, shown in FIG. 2, may be visible in proximity to a centerline 44 of the shaft 28.

Figure 2:
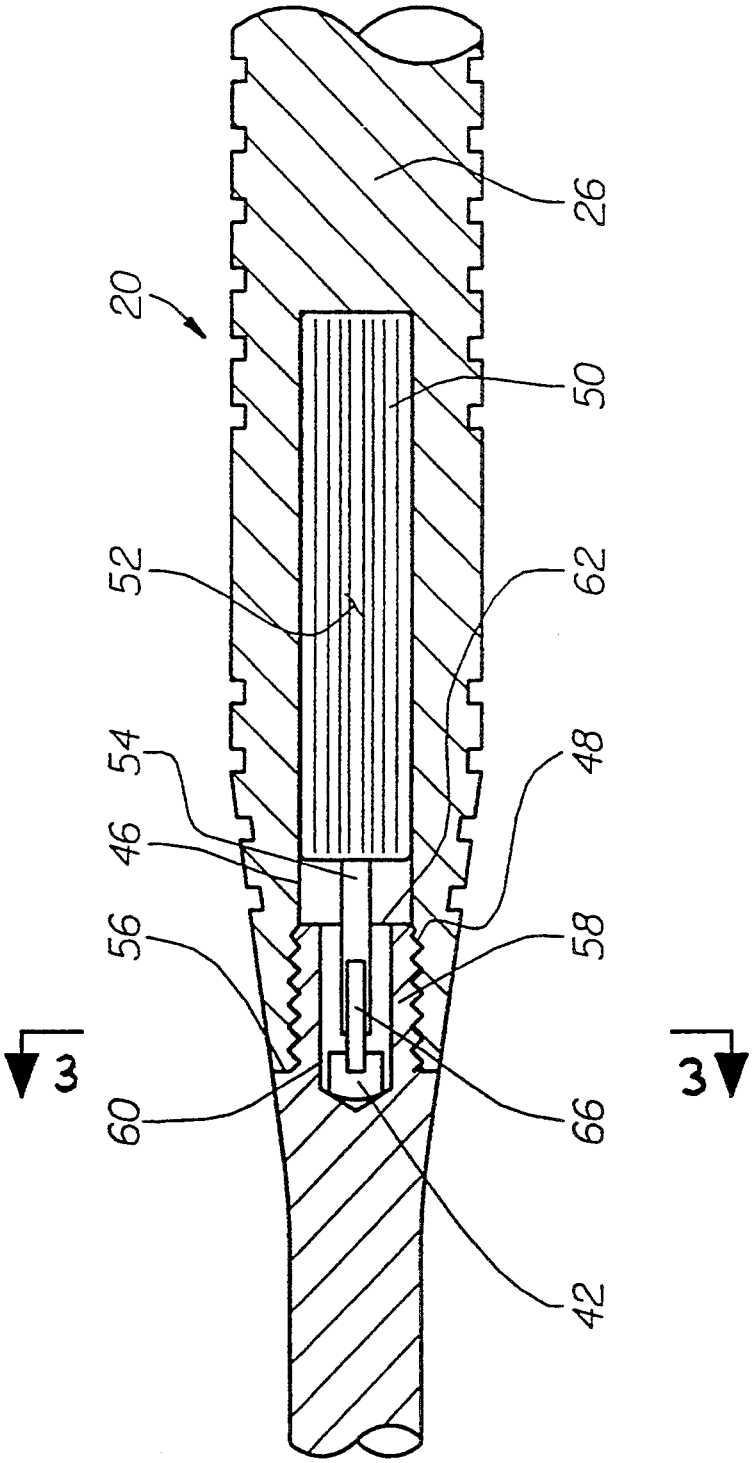
FIG. 2 is an enlarged partial cutaway view of the device shown in FIG. 1.

Turning now to FIG. 2, a bore 46 having threads formed within the mouth thereof is shown within the body 26 of the dart 20. The bore 46 is of sufficient depth and diameter to accommodate a battery 50 therein, with a battery casing 52 being in electrical contact with the body 26. The battery 50 is a commercially available pin type lithium battery in this embodiment having a 3 volt D.C. rating, although other suitable types and styles of battery may be used. A pin 54 of the battery 50 is shown extending up to a point just shy of an end 56 of the body 26 but the pin 54 may be recessed further into the body 26, or extended further into the shaft 28.

The shaft 28 has a threaded end 58 which matingly engages threads 48 of the body 26. Although internal threads 48 on the body 26 and external threads at the threaded end 58 are shown, an arrangement whereby external threads are provided on the body 26 and mating internal threads on the shaft 28 or other attachments such as cam locks, slipfit, ring and groove attachments or the like are easily envisioned. In this embodiment, an LED 42 is shown positioned at the bottom of a pin bore 60. LED 42 is a conventional device such as part number 4307TI available from Industrial Devices, Inc., Hackensack, N.J., or other commercially available diode; but has had its plastic body portion trimmed to minimum dimensions thus allowing the diameter of the pin bore 60 to be decreased to a minimum. The pin bore 60 diameter should be not less than the diameter of the battery pin 54, unless the position of the battery 50 within the bore 46 is such that the pin bore 60 can be either non-existent, or of such a size as not to allow the pin 54 to enter therein, so that contact is made at an end plane 62 of the shaft 28 or adjacent thereto. Also other surfaces of the LED 42 such as a focusing surface 64 shown in FIG. 4 may be trimmed to enhance fit and light transmission between the LED 42 and the shaft 28.

Figure 4:
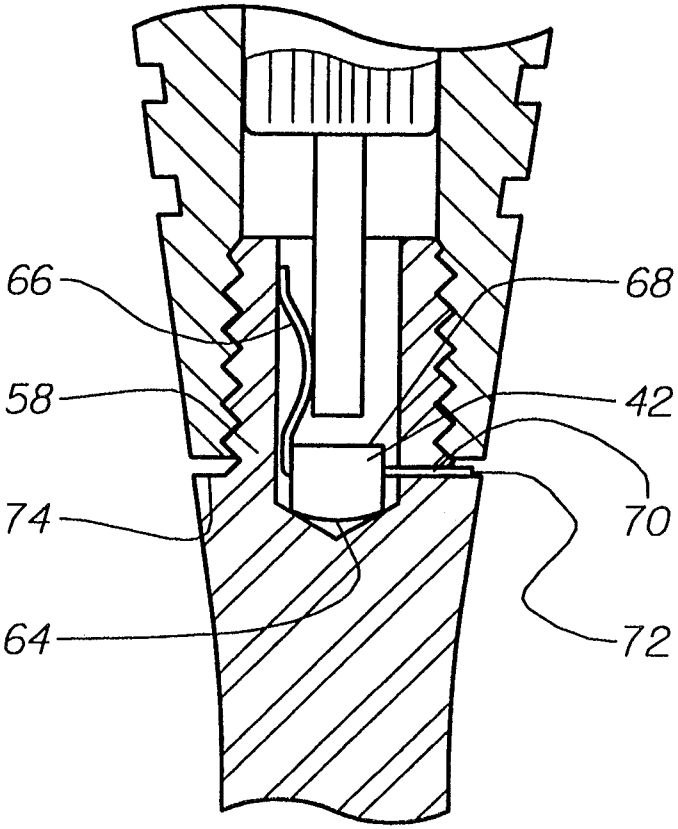
FIG. 4 is a cutaway drawing of a portion of the shaft and body shown in FIG. 3, rotated 90 degrees.
Figure 3:
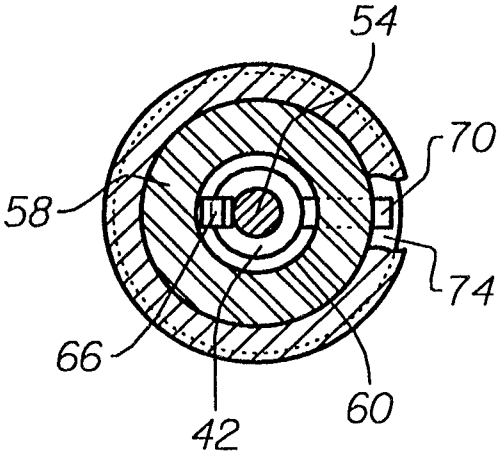
FIG. 3 is a sectional view taken along line 3—3 of FIG. 2, having a cutaway portion to more clearly show the details thereof.

The LED 42 may be anchored at the bottom of the pin bore 60 by means of a press fit, with an adhesive, or by other conventional means. The LED 42 has two leads, one of which, a lead 66, is sharply bent adjacent to the body of the LED 42 so that it lies within the pin bore 60 as shown in FIGS. 2, 3, and 4. The lead 66 may be shaped as shown in FIGS. 3 and 4 to insure more intimate contact with the pin 54, however this forming of the lead 66 may be unnecessary depending on mating characteristics of the various parts. The lead 66 may in fact expeditiously be bent and collapsed into the pin bore 60 and against a base 68 of the LED 42 by initial interaction with the pin 54. The lead 66 may also be twisted sideways in relation to the LED 42 by said initial interaction with the pin 54, as the particular configuration matters little as long as electrical contact is maintained therewith. In alternate embodiments, the lead 66 may extend through a pin bore of reduced diameter not shown, or through the plastic material of the shaft 28 itself, no bore being evident, and terminate at the end plane 62 of the shaft 28. The lead 66 may also be molded into the shaft 28 in intimate contact with the pin 54 which may also be molded therein. The battery 50 may also be molded within the shaft 28. A lead 70 of the LED 42 (FIGS. 3 and 4) may protrude through a hole, not shown, in the threaded end 58 of the shaft 28, or may be molded therein. An end 72 of the lead 70 most distant from the LED 42 is positioned to lie upon, and be preferably partially imbedded within a shoulder 74 of the shaft 28. In an alternate embodiment the lead 70 may be lengthened to allow relocation of the LED 42 in an alternate position along or adjacent to the centerline 44 of the shaft 28. The lead 66 may also be lengthened for the same purpose.

Thus it can be clearly ascertained that upon assembly, as shown in FIGS. 2 and 4, a completed electrical circuit exists wherein electricity flows from the battery casing 52 into the dart body 26, to the lead 70 of the LED 42 (which is brought into contact therewith by tightening the threads 48 and the threaded end 58 until the shoulder 74 of the shaft 28 abuts the end 56 of the body 26); said electrical current then flowing through the LED 42 and into the lead 66 and therefrom back into the battery 50 by way of the pin 54, completing the circuit. Note, however, that electrical current may flow in a direction opposite to that described, depending upon construction of the battery and LED. The LED 42 may alternatively consist of a solid state laser or similar device. The orientation of the LED 42 in respect to the shaft 28 is normally such that the focusing surface 64 of the LED 42 is in line with the centerline 44, but other orientations are foreseeable, as are multiple LED arrays. Additionally it would be feasible to use unencapsulated LEDs having no plastic body molded thereon and to imbed said bare, unencapsulated LEDs within the shaft 28, such as by first dipping said unencapsulated LEDs in epoxy to form a support structure of minimum dimensions prior to placing said LEDs into an injection mold, or otherwise supporting said bare LED.

Disconnection of said circuit is accomplished by loosening of the threaded connection between the shaft 28 and the body 26 with one quarter turn of relative rotation usually being sufficient to break the connection between the lead 70 and the end 56 of the body 26. Normally, the lead 66 maintains contact with the pin 54, but the configuration of the lead 66 may be such that the electrical circuit may be broken at that point, or between the lead 70 and the end 56, and between the lead 66 and the pin 54 simultaneously.

Figure 5:
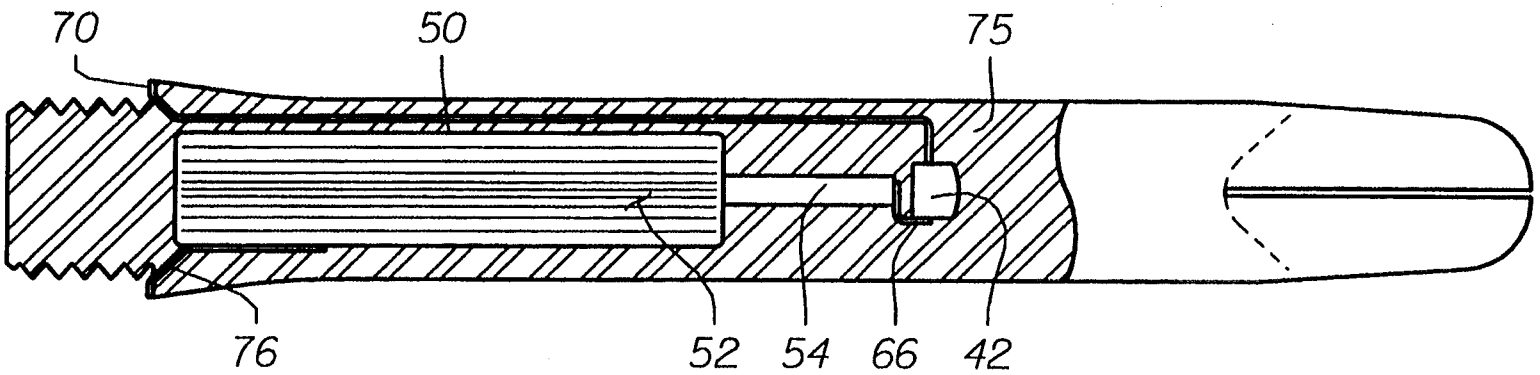
FIG. 5 shows an alternate embodiment of the invention in which the components are encapsulated within the dart shaft.

FIG. 5 shows an alternate embodiment wherein the battery 50 is contained within an injection, or otherwise, molded or formed shaft 75. The LED 42 is located adjacent thereto having the lead 66 connected to the battery pin 54 and the lead 70 being lengthened and the end thereof most distant from the LED 42 positioned upon or partially embedded within the shoulder 74 in the same manner as previously disclosed, with the lead 70 being insulated from the battery casing 52 by the material of the shaft 75. An additional lead 76 may be placed in electrical contact with the battery casing 52, with the opposite end of said lead 76 positioned upon or partially embedded within the shoulder 74 as hereinbefore described. In this embodiment switching is accomplished as described before, with the current path being from the battery casing 52 to the additional lead 76, to the end 56 of the body 26 and therefrom to the end 72 of the lead 70, through the LED 42 to the lead 66 and back to the battery 50 through the pin 54, thereby completing the circuit. Slightly unscrewing the shaft 75 from the body 26 will break the circuit as before described.

Figure 6:
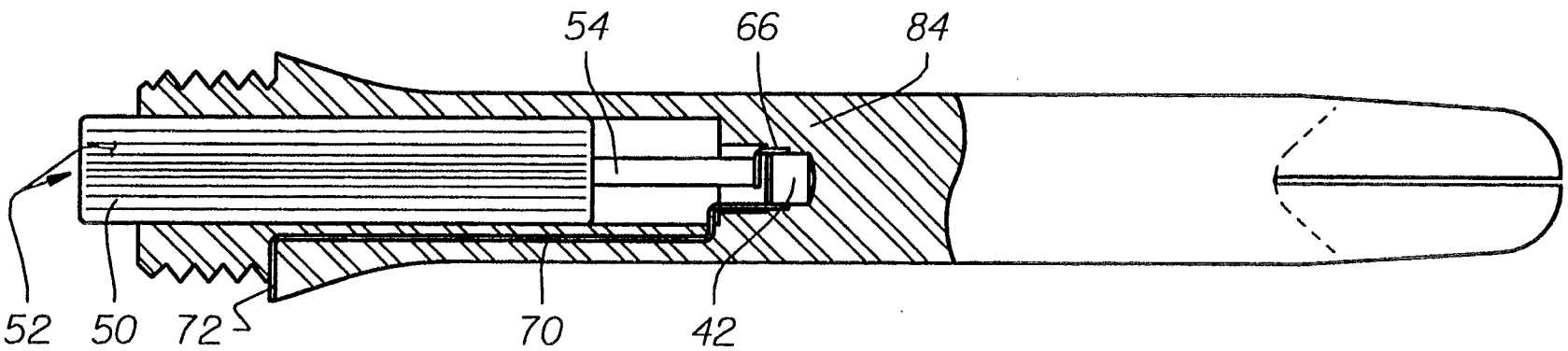
FIG. 6 shows an additional alternate embodiment in which the battery is removable.

Another alternate embodiment, shown in FIG. 6, shows the battery 50 arranged for removable insertion into a shaft 84, with the pin 54 contacting the lead 66 and the lead 70 terminating at the end 72 for connection to the body 26. The battery casing 52 is arranged to contact the body 26 thereby completing the circuit.

Switching may occur at the battery casing 52 to the body 26 interface, the body 26 to the end 72 of lead 70 interface, or the pin 54 to lead 66 interface. Plastic conductive elements may be utilized as hereinafter disclosed, and switching may be accomplished by removal and insertion of the flite 30.

Figure 8:
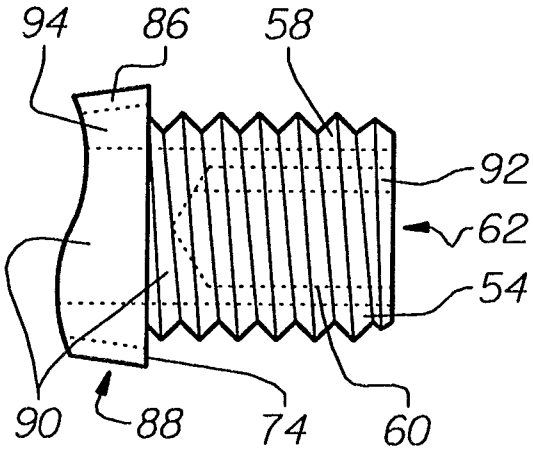
FIG. 8 is a side view of the end portion of the shaft shown in FIG. 7.
Figure 7:
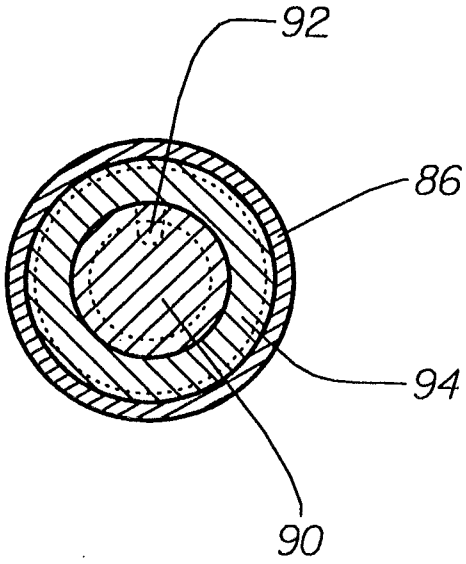
FIG. 7 is a sectional view taken along line 7—7 of FIG. 1 rotated 45 degrees about the longitudinal axis, showing only the end of the shaft.
Figure 12:
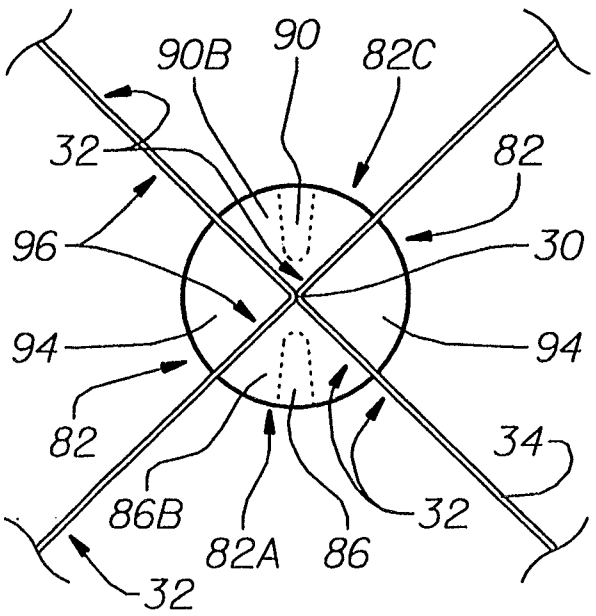
FIG. 12 is a sectional view taken along line 12—12 of FIG. 1 rotated 45 degrees about the longitudinal axis.

FIGS. 7 and 8 show another embodiment in which the battery 50 is contained within the body 26 of the dart and a conductive element 86 may form one segment of a shaft 88, running from a gripper finger 82A shown in FIGS. 1 and 12 to the shoulder 74. The conductive element 86 may or may not include the threaded end 58 of the shaft 88 in whole or in part either as a segment or circumferential section, depending upon whether switching is to be accomplished at the interface between the end 56 of the body 26 and the shoulder 74 of the shaft 88, or between the end of pin 54 and the end plane 62 of the shaft 88. A second conductive element 90 may run from a gripper finger 82C, shown in FIG. 12, diagonally opposed to a gripper finger 82A, said element 90 located opposite the conductor 86 and continuing into the center of the end plane 62, and not being in electrical contact with the shoulder 74 or with the conductive element 86. Said second conductive element 90 is disposed to make contact with the pin 54 either by end-to-end contact with the pin 54 thereby forming a switching element, or by means of the pin bore 60 formed within the threaded end 58, at least a portion of the inner wall of the pin bore 60 being formed of conductive element 90, in which case switching is accomplished at the interface of the shoulder 74 and the end 56, the threaded end 58 being nonconductive. A projection 92 may be a rib of conductive material molded into the pin bore 60 to enhance electrical contact with the pin 54.

Figure 10:
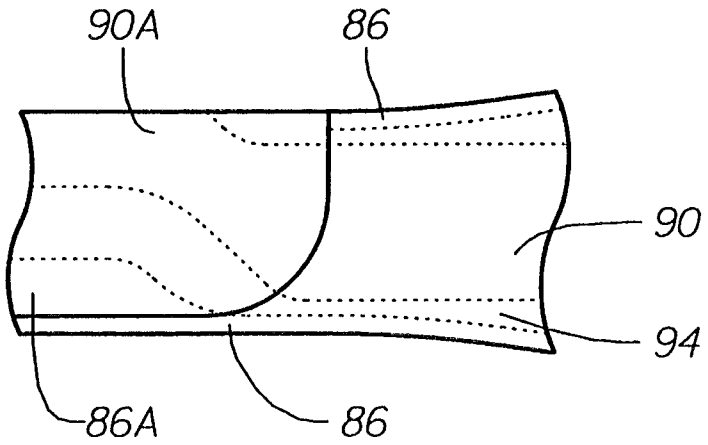
FIG. 10 is a side view of the portion of the shaft shown in FIG. 9.
Figure 9:
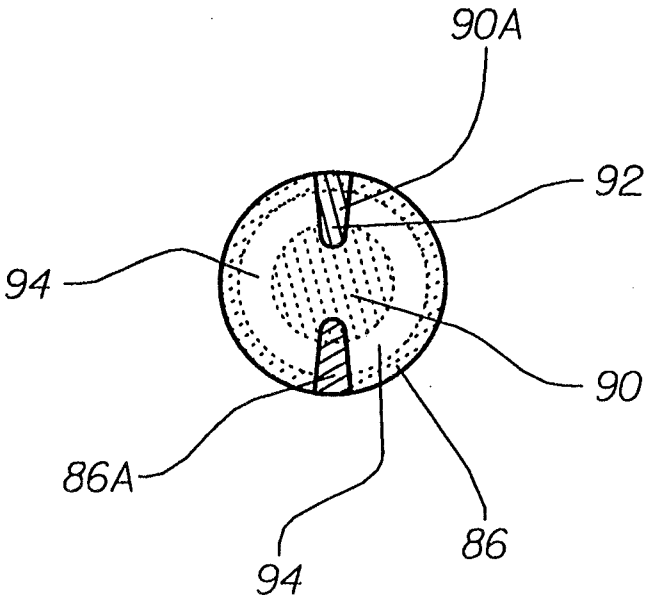
FIG. 9 is a sectional view taken along line 9—9 of FIG. 1 rotated 45 degrees about the longitudinal axis.
Figure 11:
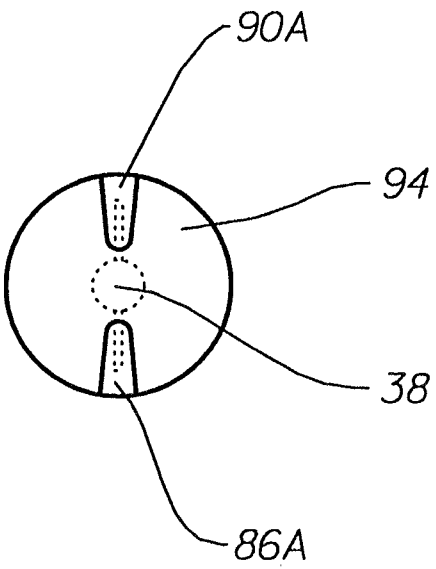
FIG. 11 is a sectional view taken along line 11—11 of FIG. 1 rotated 45 degrees about the longitudinal axis.

FIGS. 9 and 10 show the transition of the conductive segments 86 and 90 to the segments 86A and 90A, separated by an insulator 94. The conductor 90, seen in FIG. 8 which electrically contacts the pin 54 of the battery 50 follows a path of transition as shown in FIG. 10 from an innermost concentric diameter of the conductor 90 shown in FIG. 8 to a riblike conductor 90A shown in FIG. 9 and 10 which extends the remaining length of the shaft 28 into the gripper finger 82C diagonally opposed to the gripper finger 82A. The conductor 86 follows a similar transition from an outer concentric conductor 86 forming the shoulder 74 and electrically contacting the body 26, to a riblike conductor 86A similar to the riblike conductor 90A and extending in a like manner to the gripper finger 82A. FIG. 11 shows a cross section of the conductive elements 86A and 90A separated by the insulator 94 which is the plastic material of the shaft 28. The LED 38, which may if desired be an unencapsulated LED or other light emitting device, is positioned in electrical contact with the conductors 86, and 90. Multiple LEDs may be so positioned along the centerline 44 shown in FIG. 1 or adjacent thereto. FIG. 12 shows the transition of the conductors 86, and 90 into the gripper fingers 82 and more specifically into the conductive segments 86B, and 90B which are separated by the insulator 94. The flite 30 includes vanes 34 inserted between the gripper fingers 82 so that the conductors 86, and 90 are in contact with the conductive surfaces 32. The surfaces 96 may be made nonconductive so that the flite 30 may be removed, rotated 90 degrees and reinserted with the surfaces 96 in contact with the conductors 86, and 90 thereby serving as a switch.

Figure 14:
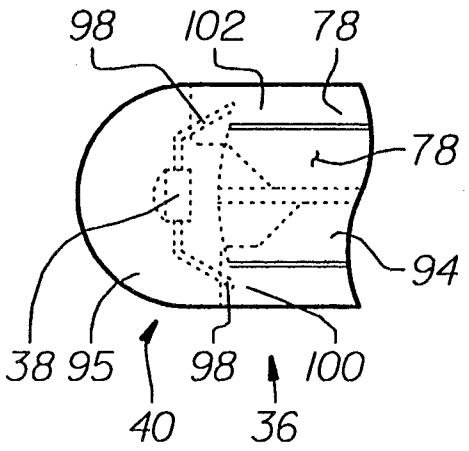
FIG. 14 is a side view of that portion of the flite guard shown in FIG. 13, with flite 30 deleted for clarity.
Figure 13:
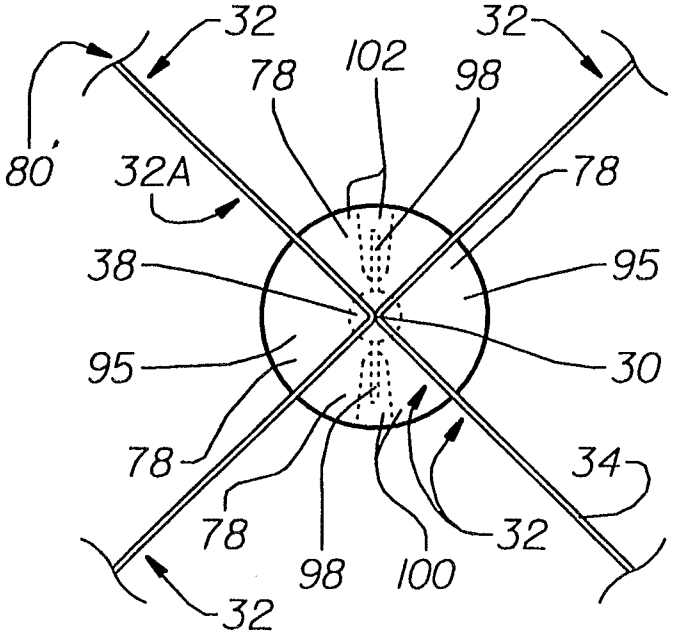
FIG. 13 is a sectional view taken along line 13—13 of FIG. 1 rotated 45 degrees about the longitudinal axis.

FIGS. 13 and 14 show details of the flite guard 36, where the grippers 78 engage the vanes 34 of the flite 30 so that conductive elements 100 and 102 are in contact with the conductive surfaces 32 of the vanes 34 of the flite 30. The vanes 34 may have the conductive outer surface 32 on one side only, as hereinbefore described, or may have an additional conductive surface 32A, the two being separated by an insulator 80 which may be a plastic film or sheet from which the flite 30 is formed. The LED 38 is embedded in an insulator 95 and has leads 98 positioned in contact with the conductive elements 100, 102, or the leads 98 may be positioned so as to contact the conductive surfaces 32 directly. Additionally, a third conductive path similar to the conductors 86 and 90 may be included within the shaft 28, having one or more LEDs embedded within the shaft 28 and electrically contacting said third conductor and conductor 90. Said third conductor may extend into one of the two gripper fingers adjacent the gripper finger 58 and between the gripper finger 58 and the diagonally opposed gripper finger into which the conductor 90 extends. By providing a non-symmetrical arrangement of conducting and non-conducting surfaces on the vanes 34 of the flite 30 such as by providing six adjacent conducting surfaces and two adjacent non-conducting surfaces, the flite 30 may be rotated relative to the shaft 28 to place said third conductor either into contact with a conducting surface of the flite 30 or into contact with a non-conducting surface. In a similar manner, the flite guard 36, may be provided with a conductive path in a manner similar to that disclosed for the shaft 28 which is oriented to electrically connect two adjacent surfaces 32 being otherwise electrically isolated by the insulator 80 shown in FIG. 13, so that three of the grippers 78 have conductive paths, and one is nonconductive in a manner similar to the gripper fingers 82. From this it should be evident that a one-quarter-turn rotation of the flite guard 36 relative to the shaft 28 would disconnect the electrical circuit to the LED 38, while a one-half-turn rotation would disconnect the electrical circuit to the LED(s) located in the shaft 28 and connected to said third conductor. In like manner, a one-quarter-turn rotation of the flite 30 relative to the shaft 28 may be made to dim or extinguish the LED(s) located within the dart 20 by changing the electrical pathways from parallel to series or by breaking the circuit.

Other configurations of parts and components falling within the scope of the present invention will occur to the skilful practitioner of the pertinent art, wherefore equivalent devices should be interpreted as falling within the bounds of the appended claims.

Having disclosed the preferred embodiments of the invention, I claim:

1. An illuminatable projectile device comprising:

a) a body;

b) a shaft movably attached to said body and forming a movable attachment therewith;

c) an electrical source means having two terminals;

d) an illuminating means having two leads;

e) switch means for conductively connecting said source means to said illuminating means, said switch means having at least a first position;

f) means in said at least one position of said switch means to complete an electrical circuit to illuminate said illuminating means;

g) said body being in electrical contact with one of said electrical terminals of said electrical source means;

h) the other terminal of said electrical source means being in electrical contact with one of said leads of said illuminating means; and i) the other lead of said illuminating means being in electrical contact with said body, thereby completing said electrical circuit.

2. The device of claim 1 wherein said movable attachment between said shaft and said body is a threaded connection.

3. The device of claim 2 wherein said switch means comprises:

a) said movable attachment between said shaft and said body;

b) said body; and c) said lead of said illuminating means which is in contact with said body.

4. The device of claim 3 wherein said illuminating means is at least one solid state device.

5. The device of claim 1 wherein at least a portion of said shaft comprises at least one electrically conductive element.

6. The device of claim 5 wherein said at least one conductive element is a conductive plastic.

7. The device of claim 6 wherein said at least one conductive element is insulated by a non-conductive plastic portion.

8. The device of claim 6 further comprising:

a) a flite removably attached to said shaft;

b) said flite having at least one conductive path;

c) said conductive path of said flite being electrically connectable to said at least one conductive path of said shaft.

9. The device of claim 8 further comprising:

a) switch means for conductively connecting said at least one conductive path of said shaft to said at least one conductive path in said flite, said switch means having at least one position;

b) means in said at least one position of said switch means to complete an electrical circuit.

10. The device of claim 8 further comprising a flite guard removably attached to said flite, said flite guard having at least one conductive path electrically connectable to said at least one conductive path of said flite.

11. The device of claim 10 further comprising said flite guard having an illuminating means electrically connectable to said at least one conductive path of said flite.

12. The device of claim 10 further comprising:

a) switch means for conductively connecting said at least one conductive path of said flite to said at least one conductive path of said flite guard, said switch means having at least one position.

b) means in said at least one position of said switch means to complete an electrical circuit.

13. The device of claim 12 further comprising said flite guard having an illuminating means electrically connectable to said at least one conductive path of said flite.

* * * * *